US006431842B1

(12) United States Patent
Furuta

(10) Patent No.: US 6,431,842 B1
(45) Date of Patent: Aug. 13, 2002

(54) FUEL INJECTION PUMP

(75) Inventor: Katsunori Furuta, Kariya (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 09/547,416

(22) Filed: Apr. 12, 2000

(30) Foreign Application Priority Data

Apr. 16, 1999 (JP) ..... 11-109208
Feb. 28, 2000 (JP) ..... 2000-50946

(51) Int. Cl.[7] ..... F04B 1/04
(52) U.S. Cl. ..... 417/273; 92/129; 123/495
(58) Field of Search ..... 417/273; 92/72, 92/129; 91/492, 493, 496; 123/495, 198 D, 198 DB

(56) References Cited

U.S. PATENT DOCUMENTS 3,945,766 A * 3/1976 Gelon ..... 417/273
4,673,337 A * 6/1987 Miller ..... 417/273
5,213,482 A * 5/1993 Reinartz et al. ..... 417/273
5,382,140 A 1/1995 Eisenbacher et al.
5,571,243 A * 11/1996 Arnold et al. ..... 123/198 DB
5,876,186 A * 3/1999 Stiefel ..... 417/273
5,979,297 A * 11/1999 Ricco ..... 92/129

FOREIGN PATENT DOCUMENTS

JP 6-249134 9/1994

* cited by examiner

*Primary Examiner*—Carl S. Miller
(74) *Attorney, Agent, or Firm*—Nixon & Vanderhye PC

(57) ABSTRACT

A fuel injection pump is provided which stops fuel discharge when a movable member for pressurizing the fuel is lifted beyond top dead center, thereby leaving a cam ring. The pump prevents the movable member from colliding with the cam ring and damaging the members of the pump. The movable member has a plunger. An outer diameter d of one portion of the plunger has a diameter smaller than an inner diameter D2 of an inner fitting surface of a cylinder in which the plunger is positioned. An outer diameter D1 of a different portion of the plunger is somewhat larger than the inner diameter D2 of the inner fitting surface of the cylinder. When a drive shaft overruns, the speed of an orbital movement of the cam. ring and a speed of reciprocating movements of the movable member increases. This causes an inertial force of the movable member in the lifting direction thereof to exceed an urging force of a spring. As such, the plunger is sometimes lifted beyond a top dead center. In such a case, the larger diameter portions press fit into the smaller inner fitting surface, and the reciprocating movements of the movable member stop.

10 Claims, 4 Drawing Sheets

FUEL INJECTION PUMP

CROSS-REFERENCE TO RELATED APPLICATION

The present invention is related to Japanese patent application No. Hei. 11-109208, filed Apr. 16, 1999; No. 2000-50946, filed Feb. 28, 2000; the contents of which are incorporated herein by reference.

1. Field of the Invention

This invention relates generally to a fuel injection pump for internal combustion engines, and more particularly to a fuel injection pump for internal combustion engines which reduces pump damage during overrunning of the internal combustion engine.

2. Background of the Invention

As disclosed in Japanese Patent Laid-Open No. 249134/1994, a fuel injection pump is known in which a driving force transmission member (cam ring), mounted eccentrically on a drive shaft, is moved orbitally corresponding to rotation of the drive shaft. The transmission member drives reciprocating plungers, arranged at equi-angular intervals circumferentially around the drive shaft. By this action, the plungers pressurize fuel that has been sucked into pressurization chambers.

An example the fuel injection pump, described above, is shown in FIG. 4. Here, a fuel injection pump 100 is shown as a radial pump in which fuel sucked into fuel pressurization chamber 106 is pressurized by reciprocating movements of plungers 102. In the fuel pump of FIG. 4, plungers 102 are typically arranged at intervals of 120° around a drive shaft 110. However, in FIG. 4, two of the three plungers 102 are omitted, leaving only one plunger shown.

The plunger 102 is supported in a cylinder 101 so that plunger 102 can be reciprocated freely. A tappet 103 slides on cam ring 112 fitted slidably around an outer circumference of a cam 113. A lower seat 104 receives an urging force from spring 105 urging plunger 102 and tappet 103 toward cam ring 112. The plunger 102, tappet 103 and lower seat 104 constitute a movable unit.

When an internal combustion engine (hereinafter engine) overruns due to abnormal combustion, drive shaft 110 overruns, causing an increase in speed of reciprocating movement of the movable unit. This causes an inertial force in the lifting direction of the movable unit to become larger than the urging force of spring 105. As a result, the tappet 103 leaves the cam ring 112.

When the tappet 103 leaves the cam ring 112, the plunger 102 travels beyond top dead center. As a result, the quantity of fuel discharged from the fuel injection pump 100 is not controlled with a high accuracy. Moreover, the elements of the movable unit can be damaged due to impact of the tappet 103, which leaves the cam ring 112, with cam ring 112. The present invention was developed in light of these drawbacks.

SUMMARY OF THE INVENTION

It is therefore an object of the present invention to provide a fuel injection pump adapted to stop the supply of fuel when a movable member for pressurizing the fuel is lifted beyond a top dead center and leaves a respective driving force transmission member.

It is another object of the present invention to keep the movable member, which has left the driving force transmission member, from colliding with the transmission member and thereby causing damage.

To accomplish these and other object of the present invention, a fuel injection pump is provided having a device for regulating reciprocating movements of the movable member when the movable member is lifted beyond top dead center. Such a fuel injection pump comprises a movable member adapted to pressurize fuel sucked into a fuel pressurization chamber. The movable member has at least a first outside diameter portion and a second outside diameter portion. A support is provided having a first bore diameter portion and a second bore diameter portion. The first bore diameter portion is slidingly engaged with the first outside diameter portion to support the movable member. A cam is mounted on and rotated with a drive shaft.

A driving force transmission member is provided between the cam and a first end of the movable member. An urging device is positioned between at least a portion of the movable member and the support. The urging device urges the movable member toward the driving force transmission member. As such, the cam, the driving force transmission member and the urging device drive the movable member in a reciprocating fashion corresponding to rotation of the cam to pressurize the fuel. Also, the second bore diameter portion has an inside diameter slightly larger than an outside diameter of the second outside diameter portion, the second outside diameter portion is positioned proximate the cam with respect to second bore diameter portion, wherein the outside diameter of the second outside diameter portion creates an interference fit with the second bore diameter portion when the movable member is lifted beyond a top dead center position. Therefore, when an engine overruns, causing the movable member to be lifted beyond top dead center, the reciprocating movements of the movable member are regulated, and fuel discharge is stopped. Moreover, since the collision of the movable member with the driving force transmission member is prevented, damage to the fuel injection pump is prevented.

In another aspect of the invention, a cam ring, mounted slidably on an outer circumference of a cam, is slidingly mounted on the movable member. As such, the cam ring moves corresponding to the rotation of the drive shaft, and thereby drives the movable member reciprocating fashion, thereby constituting the above-mentioned driving force transmission member.

According to yet another aspect of the invention, a plunger or a connecting member in the fuel injection pump is press fitted into a cylinder when the movable member is lifted beyond. the top dead center. As such, the reciprocating movements of the movable member are regulated. This enables the reciprocating movements of the plunger to be regulated by a simple structure without requiring a new member for regulating the reciprocating movements of the movable member.

Further areas of applicability of the present invention will become apparent from the detailed description provided hereinafter. It should be understood that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
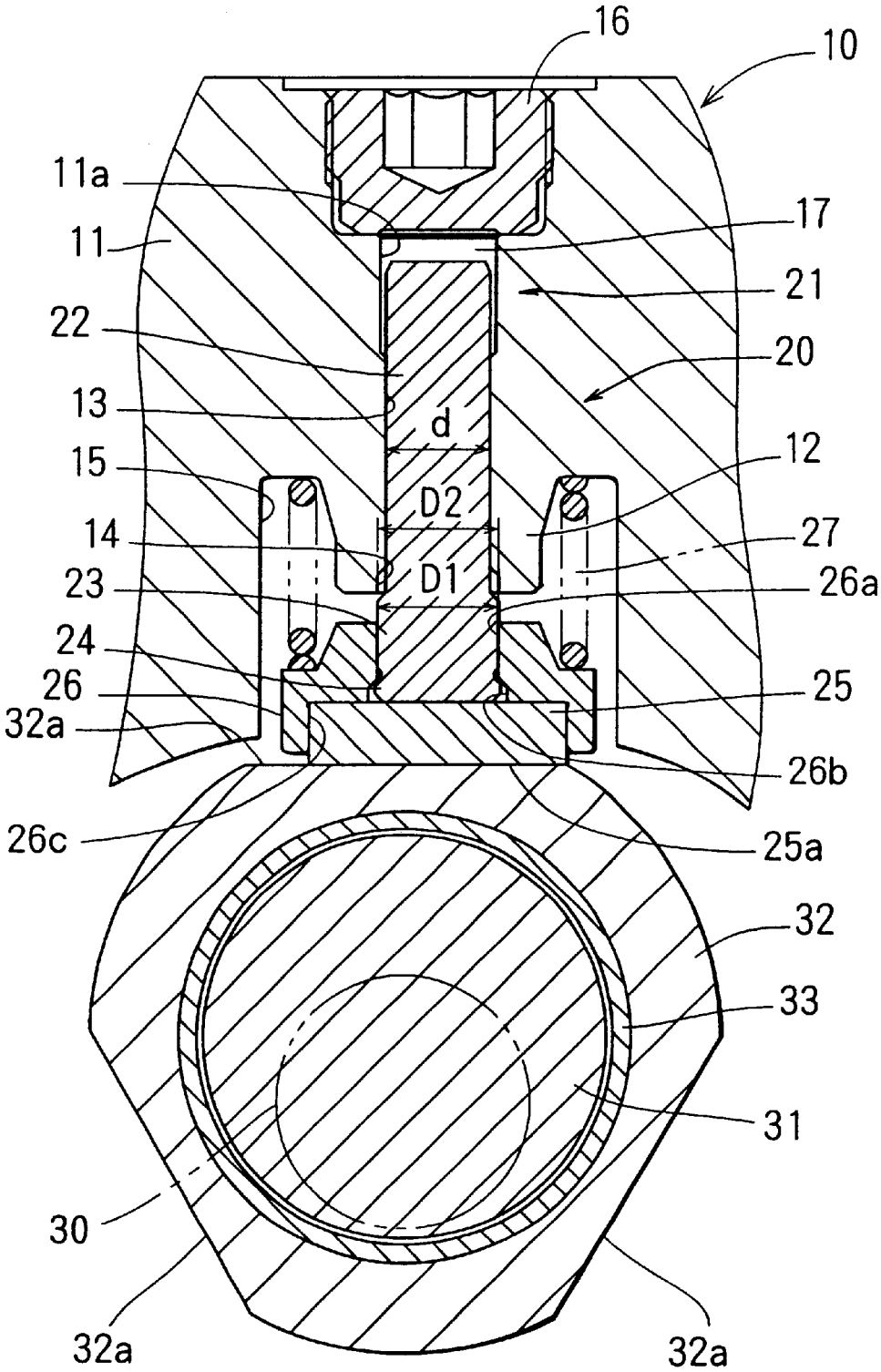
FIG. 1 is a cross-sectional view of a fuel injection pump according to a first embodiment of the present invention.
Figure 2:
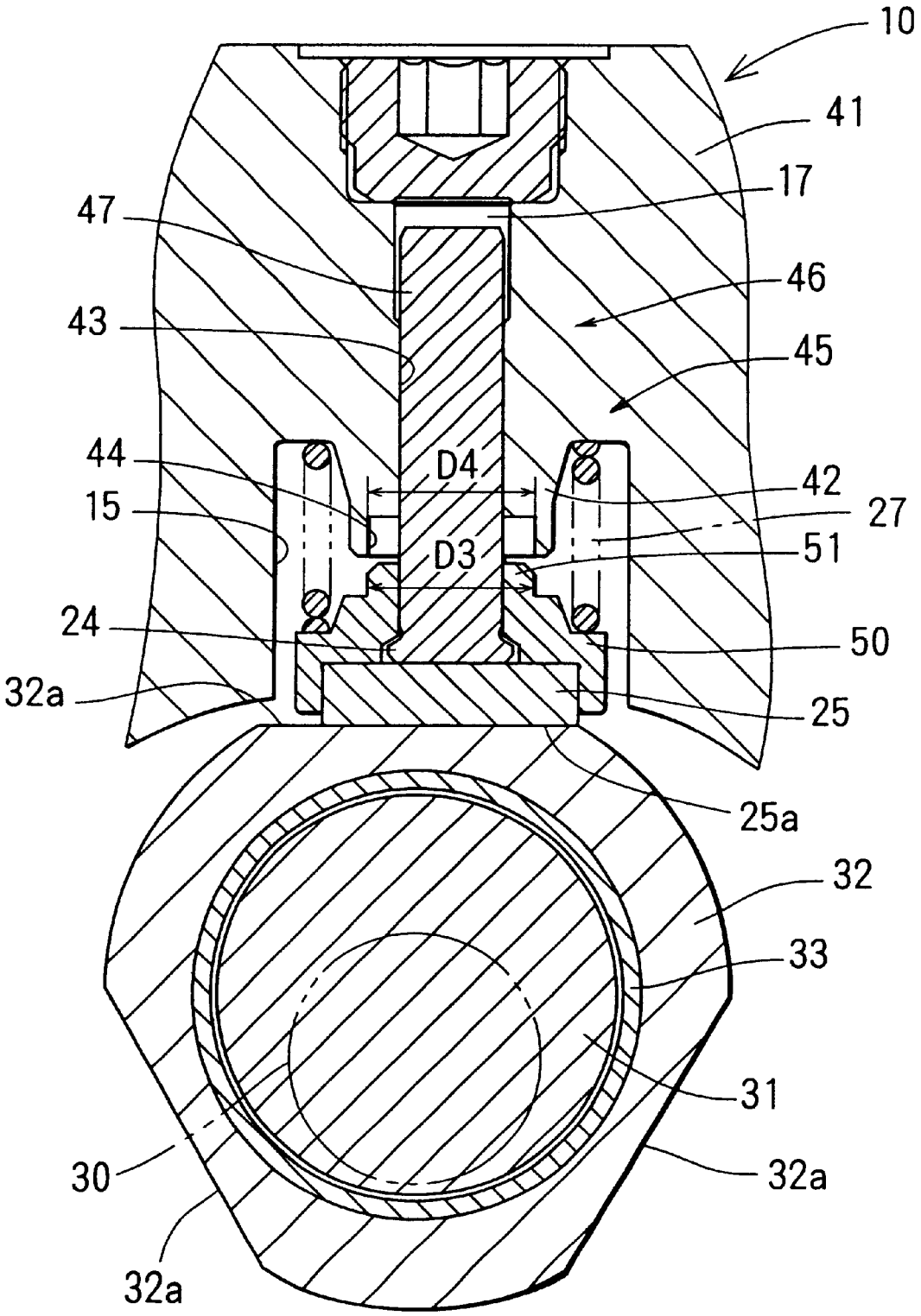
FIG. 2 is a cross-sectional view of a fuel injection pump according to a second embodiment of the present invention.
Figure 3:
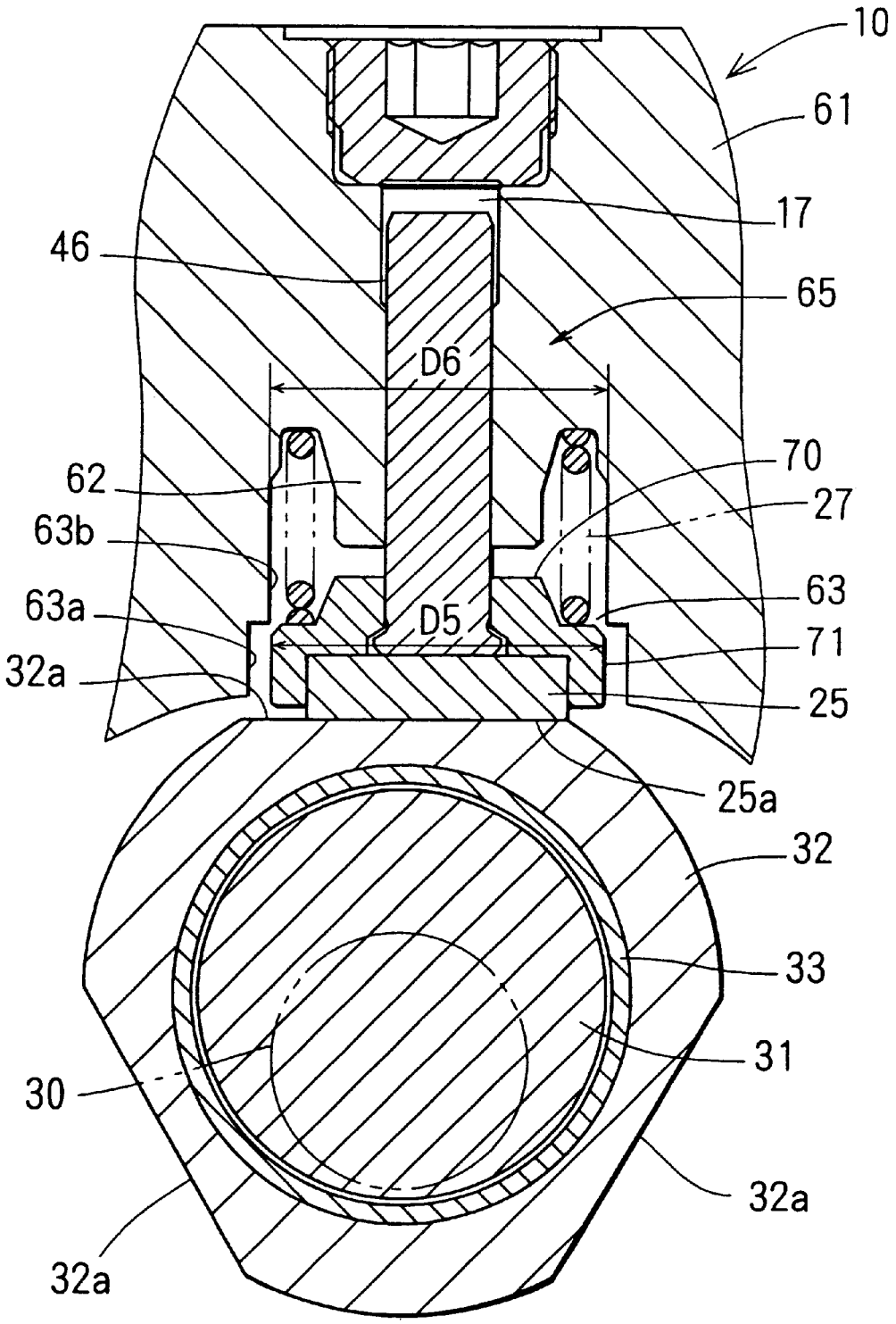
FIG. 3 is a cross-sectional view of a fuel injection pump according to a third embodiment of the present invention.
Figure 4:
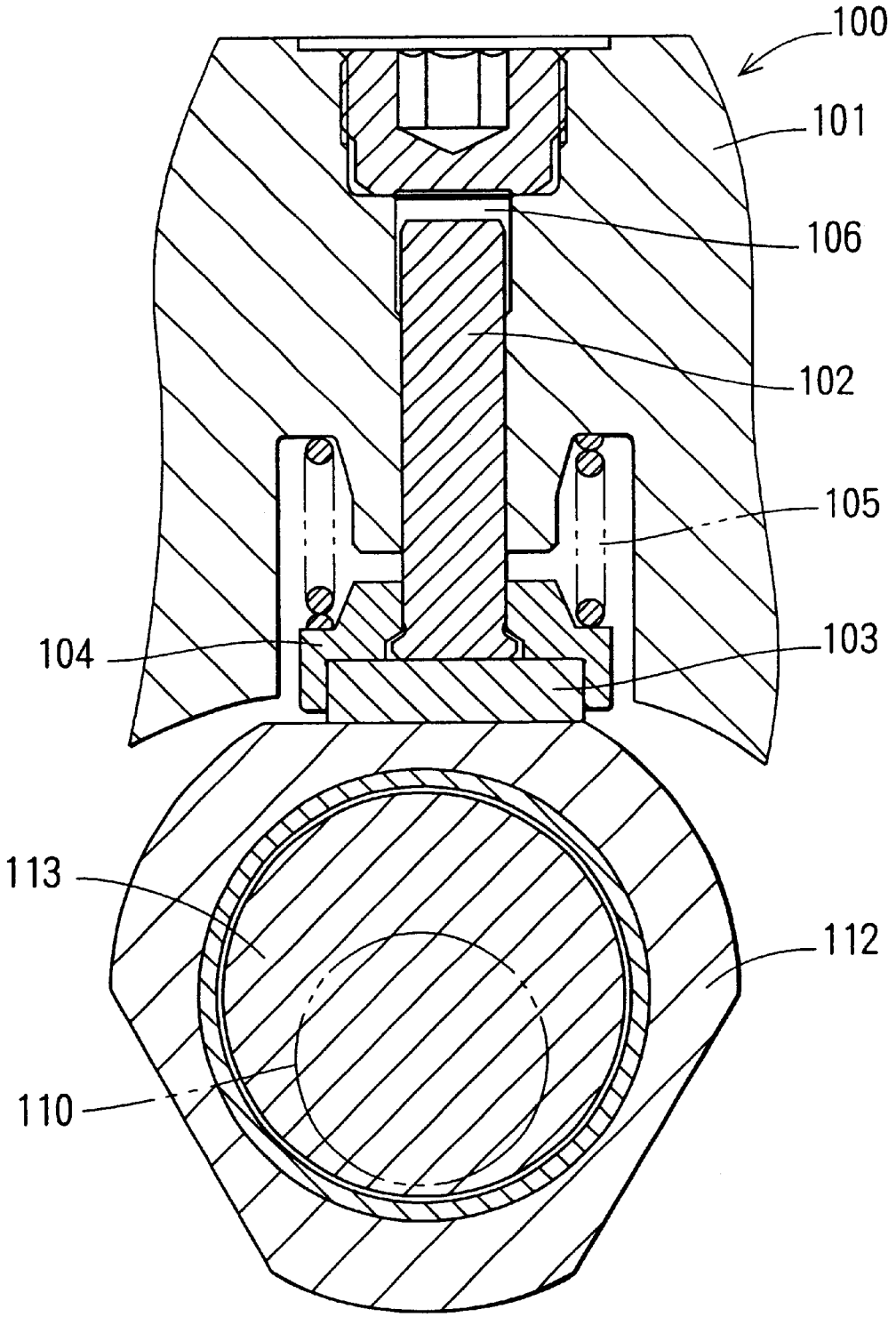
FIG. 4 PRIOR ART
FIG. 4 is a cross-sectional view of a fuel injection pump according to the prior art.

Referring now to FIG. 1, a fuel injection pump of a first embodiment of the present invention is shown and described. Fuel injection pump 10 is a radial pump for a diesel engine having three movable members 20. Although FIGS. 1–3 illustrate one movable member 20 according to the present invention, it is understood that two other movable members are included in the present invention, each operating the same as movable member 20. These movable members are angularly spaced 120° apart on an outer circumference of drive shaft 30, thereby positioning them at locations corresponding to surfaces 32*a*.

In FIG. 1, fuel is discharged from the fuel injection pump 10 and supplied from a common rail (not shown) to an injector (not shown). A holding bore 11*a* is formed in a cylinder 11 which holds a plunger 21 (which constitutes the movable member 20) such that the plunger 21 is reciprocatingly moved. One opening of the holding bore 11*a* is closed with a seal plug 16. The portion of the holding hole 11*a* for the plunger 21 which is on the side of the seal plug 16 forms a fuel pressurization chamber 17. The fuel pressurization chamber 17 communicates with a fuel suction passage (not shown) and a fuel discharge passage (not shown). A check valve for regulating the flow of the fuel in the fuel introducing direction and a direction opposite to the fuel discharging direction is provided in each fuel passage. The fuel suction passage has a feed pump (not shown) adapted to pressurize the fuel to a predetermined feed pressure and supply the resultant fuel to the fuel pressurization chamber. The fuel quantity supplied to the fuel pressurization chamber 17 is controlled according to the operational condition of an engine by a quantity regulating valve (not shown) provided on a fuel introduction side portion on the downstream side of the feed pump.

A support portion 12 supports plunger 21 to allow it to be reciprocated freely. The support plunger 21 has an inner sliding surface 13 on which plunger 21 slidingly moves. The support portion 12 also has an inner fitting surface 14 having a diameter larger than inner sliding surface 13. Inner fitting surface 14 is formed below inner sliding surface 13, proximate to cam ring 32.

Movable member 20 has plunger 21 and tappet 25 connected by lower seat 26. Plunger 21 has a smaller diameter portion 22 having an. outer sliding surface extending from the side of the fuel pressurization chamber 17 toward cam ring 32. Plunger 21 has a larger diameter portion 23 having an outer fitting surface and a head portion 24. The larger diameter portion 23 is formed below smaller diameter portion 22, which is closer to cam ring 32. Larger diameter portion 23 transitions to smaller diameter portion 22 in a tapering manner so that the diameter thereof increases gradually from the smaller diameter portion 22 to the larger diameter portion 23. An outer diameter D1 of larger diameter portion 23 is larger than diameter d of smaller diameter portion 22. However, diameter D1 is smaller than an outer diameter of head portion 24. The inner fitting surface 14 of the cylinder 11 and the outer fitting surface of the larger diameter portion 23 constitute the regulating device.

The outer diameter d of smaller diameter portion 22 of plunger 21 is smaller than an inner diameter D2 of the inner fitting surface 14 of the cylinder 11. However, the outer diameter D1 of the larger diameter portion 23 of the plunger 21 is somewhat larger than the inner diameter D2 of the inner fitting surface 14 of the cylinder 11.

The tappet 25 is engaged with head portion 24 and press fitted in the lower seat 26, thereby connecting the elements. Lower seat 26 has an inner diameter which conforms to the circumferential parts of the larger diameter portion 23 and head portion 24 of the plunger 21. As a result, a smaller diameter inner surface 26*a*, an intermediate diameter inner surface 26*b*, and a larger diameter inner surface 26*c* is provided. The inner diameter of the smaller diameter inner surface 26*a* is substantially equal to the outer diameter D1 of the larger diameter portion 23 of the plunger 21, and smaller than the outer diameter of the head portion 24. The inner diameter of the intermediate inner surface 26*b* is larger than the outer diameter of the head portion 24 of the plunger 21. The inner diameter of the larger diameter inner surface 26*c* is larger than the intermediate diameter inner surface 26*b*. The tappet 25 is press fit into the larger diameter inner surface 26*c*.

A spring 27, acting as an urging device, is engaged with spring recess 15 at one end portion and with lower seat 26 at the other end portion. Spring recess 15 is formed in cylinder 11. Since the spring 27 urges the lower seat 26 against the cam ring 32, the plunger 21 and tappet 25 are urged against the cam ring 32.

The circular cam 31 is made eccentric with respect to and integral with the drive shaft 30. A bush 33 is press fit in an inner circumference of the annularly formed cam ring 32. The cam ring 32 is fit around the cam 31 so that the inner circumferential surface of the bush 33 and the outer circumferential surface of the cam 31 slide on each other freely. The cam ring 32 has flat sliding surfaces 32*a* positioned at intervals of 120°. Each of the flat sliding surfaces 32*a* is moved slidingly on a flat sliding surface 25*a* formed on each tappet 25.

When drive shaft 30 and cam 31 rotate, the cam ring 32 is rotated orbitally without being rotated around its own axis. As a result, the flat sliding surfaces 32*a*, 25*a* slide against each other. Since the plunger 21 is urged against the cam ring 32 by the spring 27 via the lower seat 26, the plunger 21 is moved reciprocatingly in accordance with the orbital movement of the cam ring 32. When plunger 21 is moved downward, fuel is supplied to the interior of the fuel pressurization chamber 17. When the plunger 21 is moves upward, the fuel in the fuel pressurization chamber 17 is pressurized. The pressurized fuel is supplied to a common rail (not shown), from which the fuel is supplied to an injector (not shown).

When the engine overruns due to abnormal combustion, drive shaft 30 overruns, increasing the orbital speed of the cam ring 32. As a result, the speed of reciprocating movements of the movable member 20 (plunger 21, tappet 25 and lower seat 26). When this happens, the inertial force in the lifting direction of the movable member 20 exceeds the urging force of the spring 27. As such, the tappet 25 may leave the cam ring 32. The plunger 21 is lifted beyond a top dead center. When the tappet 25 leaves the cam ring 32 and the plunger 21 is lifted beyond the top dead center, the larger diameter portion 23 is press fitted into the inner fitting surface 14 since the outer diameter D1 of the larger diameter portion 23 of the plunger 21 is somewhat larger than the inner diameter D2 of the inner fitting surface 14 of the cylinder 11. The tappet 25 is press fitted in the lower seat 26, and the lower seat 26 is engaged with the head portion 24 of the plunger 21, so that, when the plunger 21 is press fitted into the cylinder 11, the plunger 21, tappet 25 and lower seat 26 stop their reciprocating movements to cause a fuel discharging operation of the fuel injection pump 10 to be stopped.

Owing to the press fitting of the plunger 21 in the cylinder 11, the collision of the movable member 20 with the cam ring 32 is prevented, so that damage, caused by the collision of movable member 20 with cam ring 32, is prevented.

A fuel injection pump of a second embodiment of the present invention is shown in FIG. 2. The same parts as the first embodiment are designated by the same reference numerals, and their descriptions have been omitted.

A support portion 42 of a cylinder 41 of a fuel injection pump 10 has an inner sliding surface 43, and an inner fitting surface 44 the diameter of which is larger than that of the inner sliding surface 43. The inner fitting surface 44 is formed on the side of the inner sliding surface 43 which is close to a cam ring 32.

A movable member 45 has a plunger 46, a tappet 25 and a lower seat 50 as a connecting member. The plunger 46 has a columnar portion 47 having an outer sliding surface, and a head portion 24 the diameter of which is larger than that of the columnar portion 47, in the mentioned order from a fuel pressurization chamber 17.

An outer diameter D3 of a fitting portion 51 formed on the side of the lower seat 50 which is close to the support portion 42 is somewhat larger than an inner diameter D4 of the inner fitting surface 44 of the cylinder 41. The inner fitting surface 44 of the cylinder 41 and the fitting portion 51 of the lower seat 50 constitute a regulating device.

When the engine overruns due to abnormal combustion thereof, a speed of the reciprocating movements of the movable member 45 formed of the plunger 46, tappet 25 and lower seat 50 increases, so that the tappet 25 leaves the cam ring 32 in some cases during the lifting of the movable member 45. An outer diameter D3 of a fitting portion 51 of the lower seat 50 is somewhat larger than the inner diameter D4 of the inner fitting surface 44 of the cylinder 11. Therefore, when the tappet 25 leaves the cam ring 32 with the plunger 46 lifted beyond a top dead center, the fitting portion 51 is press fitted into the inner fitting surface 44. The tappet 25 is press fitted in the lower seat 50 with the plunger 46 engaged with the tappet 25. Therefore, when the lower seat 50 is press fitted into the cylinder 41, the plunger 46, tappet 25 and lower seat 50 stop their reciprocating movements to cause the discharging of a fuel from the fuel injection pump 10 to be stopped.

Since the movable member 45 which has left the cam ring 32 prevents the collision thereof with the cam ring 32, damage, which is ascribed to the collision of the movable member 45 with the cam ring 32, to the movable member 45 is prevented.

A fuel injection pump of a third embodiment of the present invention is shown in FIG. 3. The constituent parts substantially identical with those of the second embodiment are designated by the same reference numerals and the duplication of the description thereof is omitted.

A support portion 62 of a cylinder 61 of a fuel injection pump 10 supports a plunger 46 so that the plunger 46 can be reciprocated freely. The support portion 62 is provided in an outer circumference thereof with a spring recess 63 in which a spring 27 is held. The spring recess 63 has a larger diameter inner surface 63*a*, and an inner fitting surface 63*b* the diameter of which is smaller than that of the larger diameter inner surface 63*a*, in the mentioned order from the side of the cam ring 32.

The movable member 65 has a plunger 46, a tappet 25, and a lower seat 70 as a connecting member. A fitting portion 71 is formed on the side of the lower seat 70, which is close to the cam ring 32. An outer diameter D5 of the fitting portion 71 is somewhat larger than an inner diameter D6 of the inner fitting surface 63*b* of the spring recess 63. The inner fitting surface 63*b* of the cylinder 61, and the fitting portion 71 of the lower seat 70 constitute a regulating device.

When the engine overruns due to abnormal combustion, the speed of the reciprocating movements of the movable member 65 (formed of the plunger 46, tappet 25 and lower seat 70) increases. Therefore, the tappet 25 sometimes leaves the cam ring 32 during lifting of the movable member 65. An outer diameter D5 of the fitting portion 71 of the lower seat 70 is somewhat larger than an inner diameter D6 of the inner fitting surface 63*b* of the spring recess 63. Therefore, when the tappet 25 leaves the cam ring 32 with the plunger 46 lifted beyond a top dead center, the fitting portion 71 is press fit into the inner fitting surface 63*b*. Likewise, the tappet 25 is press fit into the lower seat 70, and the plunger 46 is engaged with the tappet 25. Therefore, when the lower seat 70 is press fitted into the cylinder 61, the plunger 46, tappet 25 and lower seat 70 stop their reciprocating movements, causing the discharging fuel from the fuel injection pump 10 to be stopped.

Since the movable member 65, after leaving cam ring 32, prevents collision thereof with cam ring 32, damage to the movable member 65, ascribed to the movable member 65 colliding with cam ring 32, is prevented.

In the above-described embodiments, a movable member is press fit into a cylinder when the engine overruns to cause a speed of reciprocating movements of a movable member to increase according to an increase in the rotational speed of a drive shaft, the movable member to leave a cam ring, and the movable member to be lifted beyond a top dead center. This press fitting prevents discharge of fuel when the engine overruns. Moreover, the collision of the movable member with the cam ring is prevented, so that damage to the movable member is prevented.

Although the tappet is press fit into the lower seat in the above-described embodiments, it is understood that the lower seat and tappet may be welded together. Although the movable member comprises the plunger, tappet and lower seat, it is understood that it may also be constructed by making the plunger, tappet and lower seat integral with each other, or by making the plunger and lower seat or the plunger and tappet integral with each other.

In the above-described embodiments, a radial pump having a movable member arranged radially on an outer circumference of the drive shaft is described. It is noted that the structure of the present invention can also be applied to a fuel injection pump wherein only one movable member is provided on an outer circumference of the drive shaft.

In the above-described embodiments, a fuel injection pump having a cam ring employed as a driving force. transmission member is described. The structure of the present invention can be applied not only to this type of pump, but also to an in-line pump.

When the movable member in the above described embodiments is press fit into the cylinder due to the overrunning of the engine, the forced feeding of a fuel by the movable member to the common rail is stopped.

Consequently, the rotational frequency of the engine decreases due to this stoppage of the forced feeding of a fuel. The fuel injection pump may also be formed so that the degree of fitting of the cylinder and movable member is regulated such that the movable member comes off the cylinder and regains a normal operating condition when a predetermined feed pressure of fuel is supplied from the feed pump to the fuel pressurization chamber. When the movable member is returned to the cam ring in this in this fashion, during a safe condition of decreased engine rotational speed, the pump is restored to a normal operating condition without causing members of the pump to be damaged.

While the above-described embodiments refer to examples of usage of the present invention, it is understood that the present invention may be applied to other usage, modifications and variations of the same, and is not limited to the disclosure provided herein.

What is claimed is:

1. A fuel injection pump comprising:

a movable member adapted to pressurize fuel sucked into a fuel pressurization chamber;

a cylinder supporting the movable member slidingly and reciprocatingly;

a cam mounted on and rotated with a drive shaft;

a driving force transmission member provided between the cam and movable member, said transmission member adapted to drive the movable member reciprocatingly in accordance with a rotation of the cam;

a device for urging the movable member toward the driving force transmission member; and a regulating means adapted to regulate a reciprocating movement of the movable member when the movable member is lifted beyond a top dead center, wherein the movable member has a plunger opposed to the fuel pressurization chamber, and a connecting member receiving an urging force of the urging device toward the driving force transmission member and moved reciprocating with the plunger;

the cylinder having an inner sliding surface on which the plunger is moved slidingly, and an inner fitting surface provided on the side of the inner sliding surface which is close to the driving force transmission member and having a diameter larger than that of the inner sliding surface; and the connecting member being press fitted into the inner fitting surface when the movable member is lifted beyond the top dead center, whereby a reciprocating movement of the movable member is regulated.

2. A fuel injection pump according to claim 1, wherein the driving force transmission member is a cam ring fitted around an outer circumferential surface of the cam so that the cam ring can be slid freely with respect to the cam, and moved slidingly on the movable member in accordance with a rotation of the drive shaft and thereby driving the movable member reciprocatingly.

3. A fuel injection pump comprising:

a movable member adapted to pressurize fuel sucked into a. fuel pressurization chamber;

a cylinder supporting the movable member slidingly and reciprocatingly;

a cam mounted on and rotated with a drive shaft;

a driving force transmission member provided between the cam and movable member, said transmission member adapted to drive the movable member reciprocatingly in accordance with a rotation of the cam;

a device for urging the movable member toward the driving force transmission member;

a regulating means adapted to regulate a reciprocating movement of the immovable member when the movable member is lifted beyond a top dead center and a holding means for holding the movable member at a position beyond top dead center.

4. A fuel injection pump according to claim 3, wherein:

the movable member has a plunger oppositely positioned to the fuel pressurization chamber;

the plunger has an outer sliding surface which moves slidingly in the cylinder, said plunger having an outer fitting surface provided on the side of the outer sliding surface which is close to the driving force transmission member and having a diameter larger than that of the outer sliding surface;

the cylinder has an inner sliding surface on which the outer sliding surface is moved slidingly, and an inner fitting surface provided on the side of the inner sliding surface which is close to the driving force transmission member and having a diameter larger than that of the inner sliding surface; and the outer fitting surface is press fit into the inner fitting surface when the movable member is lifted beyond the top dead center, whereby the reciprocating movement of the movable member is regulated.

5. A fuel injection pump according to claim 3, wherein the movable member has a plunger opposed to the fuel pressurization chamber, and a connecting member receiving an urging force of the urging device toward the driving force transmission member and moved reciprocatingly with the plunger;

the cylinder having an inner sliding surface on which the plunger is moved slidingly, and an inner fitting surface provided on the side of the inner sliding surface which is close to the driving force transmission member and having a diameter larger than that of the inner sliding surface; and the connecting member being press fitted into the inner fitting surface when the movable member is lifted beyond the top dead center, whereby a reciprocating movement of the movable member is regulated.

6. A fuel injection pump according to claim 5, wherein the driving force transmission member is a cam ring fitted around an outer circumferential surface of the cam so that the cam ring can be slid freely with respect to the cam, and moved slidingly on the movable member in accordance with a rotation of the drive shaft and thereby driving the movable member reciprocatingly.

7. A fuel injection pump comprising:

a movable member adapted to pressurize fuel sucked into a fuel pressurization chamber, said movable member having at least a first outside diameter portion and a second outside diameter portion;

a support having a first bore diameter portion and a second bore diameter portion, said first bore diameter portion slidingly engaged with said first outside diameter portion to support said movable member;

a cam mounted on and rotating with a drive shaft;

a driving force transmission member provided between said cam and a first end of said movable member; and an urging device positioned between at least a portion of said movable member and said support, said urging device urging said movable member toward said driving force transmission member;

wherein said cam, said driving force transmission member and said urging device drive said movable member in a reciprocating fashion corresponding to rotation of said cam to pressurize said fuel;

wherein said second bore diameter portion has an inside diameter slightly larger than an outside diameter of said second outside diameter portion, said second outside diameter portion is positioned proximate said cam with respect to second bore diameter portion, wherein said outside diameter of said second outside diameter portion engages with said second bore diameter portion when said movable member is lifted beyond a top dead center position.

8. A fuel injection pump comprising:

a movable member adapted to pressurize a fuel sucked into a fuel pressurization chamber;

a support having a cylinder, said cylinder slidingly supporting the movable member;

a cam mounted on and rotated with drive shaft;

a driving force transmission member positioned between the cam and movable member, said driving force transmission member positioned against said movable member, said driving force transmission member driving the movable member reciprocatingly in accordance with a rotation of the cam, an urging device supplying force against the movable member, wherein the urging device urges the movable member toward the driving force transmission member, and wherein a portion of said movable member has an outside diameter, a portion of said cylinder having an inside diameter, said outside diameter being slightly larger than said inside diameter to cause an interference fit between, said movable member and said cylinder when said movable member is lifted beyond a top dead center, whereby said outside diameter and said inside diameter regulate a reciprocating movement of the movable member when the movable member is lifted beyond a top dead center.

9. A fuel injection pump according to claim 8, wherein the movable member has a plunger opposed to the fuel pressurization chamber, the plunger having an outer surface constituting said outside diameter, said portion of said cylinder having said inside diameter being positioned proximate said cam with respect to a remainder of said cylinder.

10. A fuel injection pump according to claim 8, wherein:

the movable member has a plunger opposed to the fuel pressurization chamber, said movable member having a connecting member receiving said urging force from said urging device, said connecting member having said outside diameter; and the connecting member being press fitted into the inside diameter when the movable member is lifted beyond the top dead center, whereby a reciprocating movement of the movable member is regulated.

* * * * *